United States Patent [19]

Zurru et al.

[11] Patent Number: 4,856,314

[45] Date of Patent: Aug. 15, 1989

[54] DIE EXCHANGE DEVICE FOR HORIZONTAL AXIS EXTRUDING PRESSES

[75] Inventors: Sergio Zurru, San Donato Milanese; Romano Alberti, Turate, both of Italy

[73] Assignee: Innse Innocenti Santeustacchio S.p.A., Brescia, Italy

[21] Appl. No.: 141,522

[22] Filed: Jan. 7, 1988

[30] Foreign Application Priority Data

Jan. 8, 1987 [IT] Italy ..... 19021 A/87

[51] Int. Cl.[4] ..... B21C 27/00

[52] U.S. Cl. ..... 72/263

[58] Field of Search ..... 72/263, 255, 273.5

[56] References Cited

U.S. PATENT DOCUMENTS

| | | | |
|---|---|---|---|
| 3,561,243 | 2/1971 | Valks et al. | 72/263 |
| 4,020,668 | 5/1977 | Doudet | 72/263 |
| 4,402,208 | 9/1983 | Sibler | 72/263 |

FOREIGN PATENT DOCUMENTS

| | | | |
|---|---|---|---|
| 1152084 | 8/1963 | Fed. Rep. of Germany | 72/263 |
| 106618 | 6/1985 | Japan | 72/263 |
| 199518 | 10/1985 | Japan | 72/263 |
| 897040 | 5/1962 | United Kingdom | 72/263 |

*Primary Examiner*—Robert L. Spruill

*Attorney, Agent, or Firm*—Birch, Stewart Kolasch & Birch

[57] ABSTRACT

A die exchange device for horizontal axis extruding presses comprises a supporting column provided with guides extending therealong, a carriage movable along the guides and provided with two rest shelves, each for a respective die holding slide, drive means to take each shelf to a die exchange position close to an extrusion working position of the press, and a pusher for shifting a die holding slide from the die exchange position to the extrusion working position, and vice versa.

2 Claims, 4 Drawing Sheets

XII

DIE EXCHANGE DEVICE FOR HORIZONTAL AXIS EXTRUDING PRESSES

BACKGROUND OF THE INVENTION

This invention relates to a die exchange device for horizontal axis extruding presses having a working position whereat an extrusion die is held during the extrusion process. In particular, this invention relates to a die exchange device for presses used to extrude profile articles of either steel or aluminum and non-ferrous materials in general.

As is known, of particular concern with extruding presses is the die exchange operation, which is carried out to either replace the dies, or have them cleaned or refaced.

To effect the die exchange, known and commonly used is a device consisting of a carriage with two die holding slides which is movable along the horizontal plane containing the extrusion axis and perpendicularly to that axis, the die loading being performed alternately from either sides of the press by means of this device. For this reason, the use of such a die exchange device has the drawback that the maintenance personnel are forced into awkward movements around the press which, as is well known, has usually a large size. Further, the maintenance work is made specially difficult by the die exchange device being mounted at the same level as the extrusion axis, i.e. at about 1 m above the floor.

SUMMARY OF THE INVENTION

The problem underlying this invention is to provide a die exchange device which has such constructional and operational features as to enable easier effectuation of the manual operations for die maintenance, cleaning and/or refacing, while overcoming the noted drawbacks affecting the prior art.

This problem is solved according to the invention by a die exchange device being characterized in that it comprises a supporting column provided with guides extending therealong, a carriage movable along said guides and provided with at least two superimposed rest shelves in mutually spaced-apart relationship and each arranged to carry a respective die holding slide, drive means operative on said carriage to take each of said shelves and respective slides to a die exchange position close to said working position, and pusher means effective to shift a die holding slide from said die exchange position to said working position, and vice versa.

BRIEF DESCRIPTION OF THE DRAWINGS

Further features and the advantages of a die exchange device according to the invention will be apparent from the following detailed description of a preferred embodiment thereof, to be taken by way of illustration and not of limitation in conjunction with the accompanying drawings.

In the drawings.

DETAILED DESCRIPTION OF THE PREFERRED EMBODIMENTS

Figure 1:
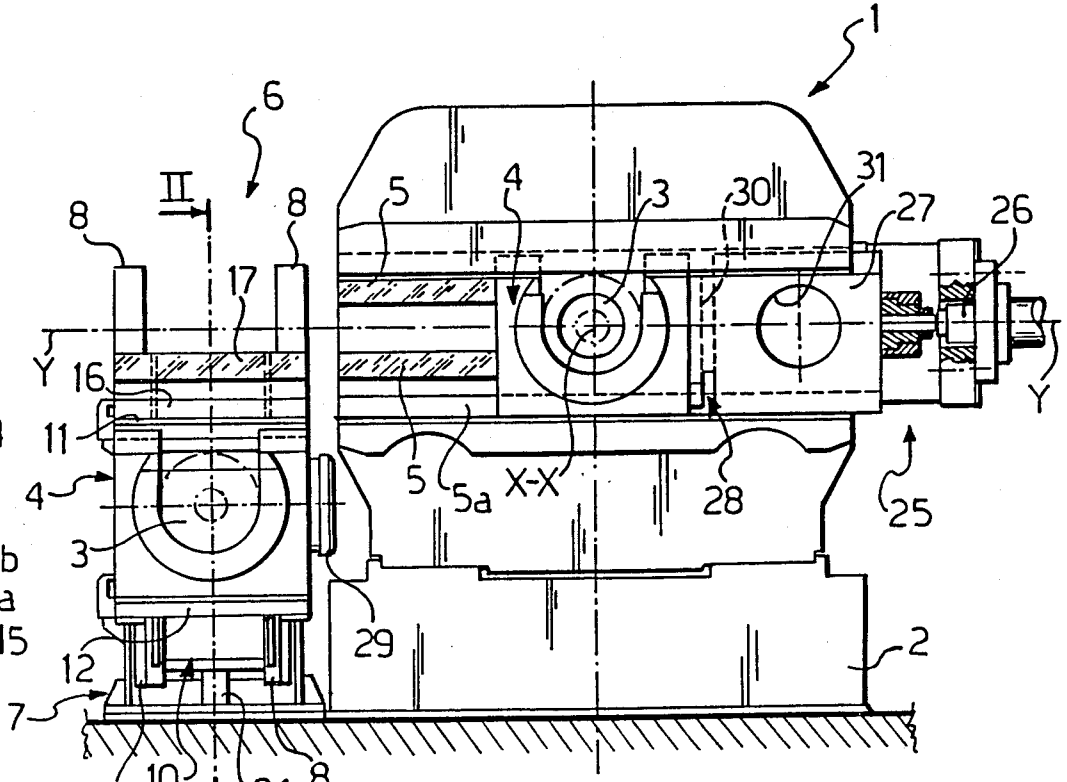
FIG. 1 is a front view showing schematically a horizontal extruding press and a die exchange device according to this invention.
Figure 2:
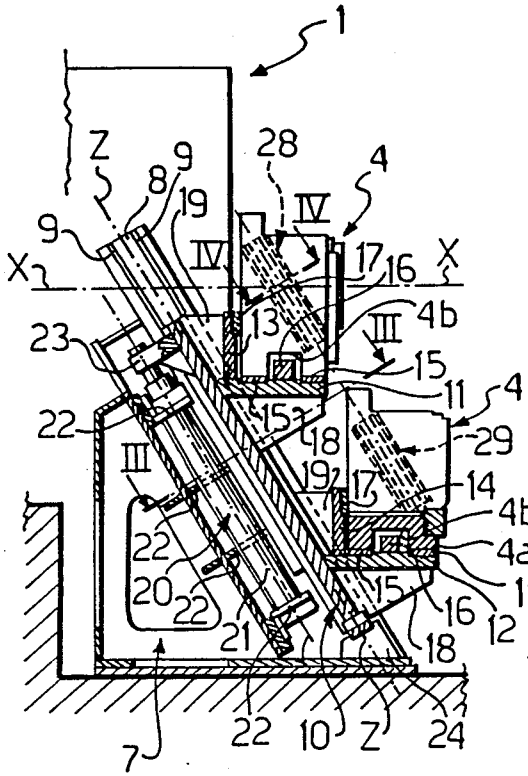
FIG. 2 is a sectional view taken through the device of FIG. 1 along the line II—II.
Figure 4:
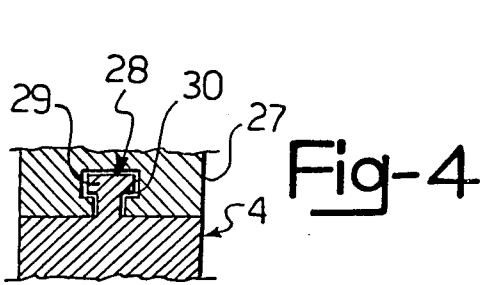
FIG. 4 is an enlarged scale sectional view of a detail of the inventive device, taken along the line IV—IV in FIG. 2.
Figure 3:
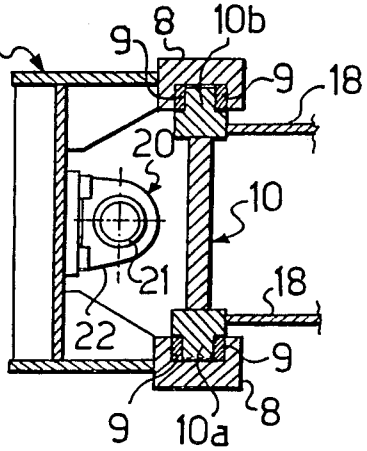
FIG. 3 is an enlarged scale sectional view of a detail of the inventive device, taken along the line III—III in FIG. 2.

With reference to the drawing views, the numeral 1 generally designates an extruding press of a type known per se, which stands on a conventional bed 2 and has a horizontal extrusion axis X—X along which a punch, not shown, is driven.

On the press 1 there is defined an extrusion working position on the extrusion axis X—X, at which position a conventional extrusion die 3 carried on a die holding slide 4 is brought at the extruding time.

The die holding slide 4 comprises a substantially U-shaped base **4*a* for supporting and containing the die 3 and its related abutment disks. The reference character 4*b* denotes a groove formed in the base 4*a* of the slide 4**.

The press 1 has guides, all indicated at 5, lying parallel to an axis Y—Y located at the same level as and extending perpendicularly to the extrusion axis X—X. The guides 5 extend transversely of the press 1 at said extrusion working position. More specifically, a first pair of the guides 5 are formed on a vertical flat portion of the press 1, and a second guide pair, not shown, are formed on an adjoining horizontal flat portion of the press, said pairs of the guides 5 being adapted to accommodate a die holding slide 4 for sliding movement along the axis Y—Y.

Indicated at **5*a* is a central guide extending between the second pair of the guides 5 and adapted to fit in the groove 4*b* of the slide 4**.

Indicated at 6 is a die exchange device according to the present invention which is disposed laterally of the press 1 close to the extrusion working position.

The die exchange device 6 comprises a supporting column 7 provided with two guides 8, oppositely located and parallel to each other which extends along an inclined direction Z—Z from the vertical by an angle which, in the exemplary embodiment under consideration, is of about 30°.

The guides 8 have a C-like cross-sectional shape and are provided internally with respective pairs of plain bearings 9 spanning the full length of the guides 8.

The device 6 further comprises a carriage 10 substantially in the form of a table carried on the column 7 for movement along the guides 8, with oppositely located ends **10*a* and 10*b* fitting slidingly in between the corresponding pairs of the plain bearings 9**.

On the carriage 10 there are formed two rest shelves identical with each other, respectively an upper one 11 and a lower one 12, in a stepped arrangement, each to carry a respective die holding slide 4.

More specifically, the rest shelves 11 and 12 extend along horizontal planes, being separated by a distance which is set according to the size of the die holding slides 4.

To each shelf, 11 and 12, there is attached a respective upright wall 13, thereby the shelves and said upright walls form two brackets with an L-shaped cross-section which are supported on the carriage 10 cantilever-fashion.

A respective pair of guides 15 are formed in the shelves 11 and 12 which extend in parallel with the axis Y—Y and are separated by a distance equal to the distance separating the guides in the aforesaid guide pairs in the press 1.

Further, each shelf, 11 and 12, is provided at the top with a respective central guide 16 which extends between the corresponding guide pair 15, said central guide 16 being adapted to fit into the groove **4*b* of the die holding slide 4. A guide 17, quite similar to the guides 15 and 5, is also formed in the upright walls 13 and 14** to lie in parallel with the axis Y—Y.

Indicated at 18 are pairs of ribs supporting the shelves 11 and 12 and being welded to the carriage 10, while the numeral 19 designates similar rib pairs for securing the upright walls 13 and 14 to the carriage 10.

According to the invention, moreover, drive means 20 are operative on the carriage 10 to drive it along the inclined guides 8. Said drive means 20 comprise a hydraulic cylinder 21 supported on the column 7 through flanges 22 and having a respective piston rod 23 fast with the carriage 10 at its upper end.

It should be noted that the drive means 20 are operative on the carriage 10 to take each of the shelves 11 and 12 to a die exchange position, at the same level as and close to the extrusion working position of the press 1, at which position the guides 15 of the shelf 11 (12) and the guide 17 of the corresponding upright wall 13 (14) will be aligned to the guides 5 formed on the press 1, and the central guide 16 likewise aligned to its corresponding central guide **5*a***.

A bottom travel limit stop for the carriage 10 is indicated at 24 which is formed on the column 7.

The die eaxchange device 6 according to the invention also comprises pusher means, generally indicated at 25, which are mounted on the press 1 at the guides 5, on the remote side from the column 7, said pusher means 25 being provided to shift a respective die holding slide 4 from the shelf 11 (12), in the die exchange position noted above, to the extrusion working position, or vice versa.

The pusher means 25 comprise a hydraulic cylinder 26 whose axis is coincident with the axis Y—Y, and a body 27 movable along the guides 5 by the action of said hydraulic cylinder 26 and adapted to engage with a die holding slide 4 through coupling means 28.

The coupling means 28 are comprised of a lug 29 having a hammerhead-shaped cross-section and being secured, for each slide 4, along one side thereof and extending along the direction Z—Z inclined by about 30° from the vertical, as well as a grooved seat 30 shaped to mate with the lug 29 and being open at opposed ends thereof and formed in the body 27 of the pusher means 25.

The body 27 is advantageously provided with a hole 31 for the passage of billets to be pushed out of a magazine (not shown) of the press, without the billets becoming extruded through the die.

Figure 5:
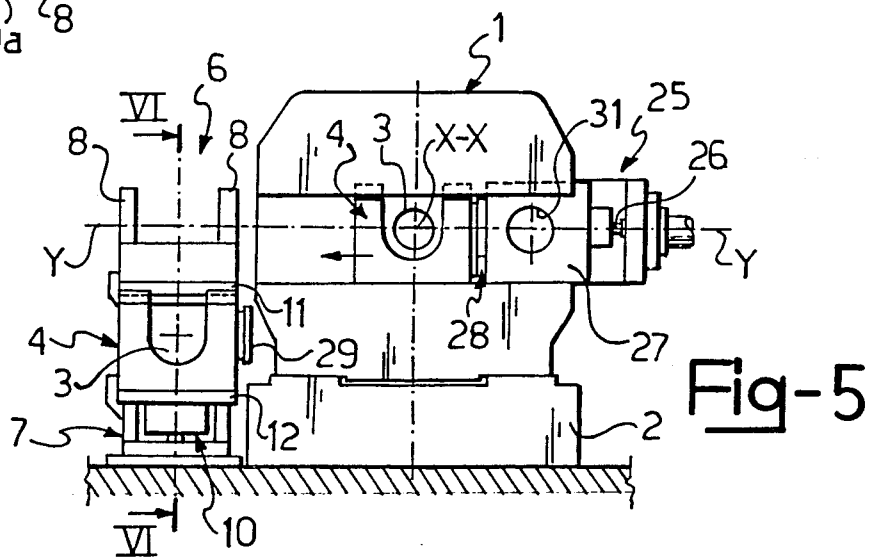
FIGS. 5, 7 and 9 are diagramatic views of the inventive device at successive stages of its operation.
Figure 6:
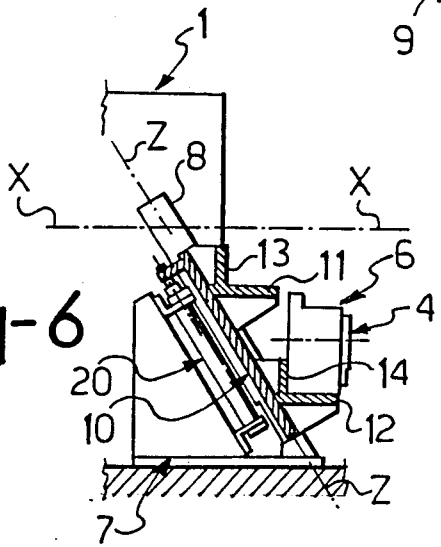
FIGS. 6, 8 and 10 are diagramatic sectional views of the inventive device taken at successive stages of its operation along the lines VI—VI, VIII—VIII and X—X, respectively.

The operation of the die exchange device 6 according to the invention will be now described with reference to FIGS. 5 and 6 which illustrate a starting condition in which the upper rest shelf 11 of the device 6 occupies the above-noted die exchange position and the respective die holding slide 4 and corresponding die 3 are placed in the extrusion working position of the press 1.

It should be noted in this starting condition the hammerhead lug 29 on the slide 4 of the top shelf 11 fits into the grooved seat 30 on the body 27, and accordingly, the pusher means 25 are in engagement with the slide 4.

Figure 7:
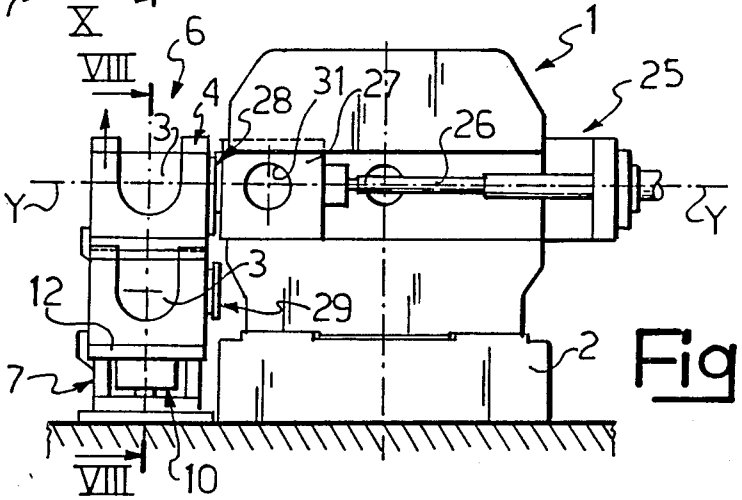
Figure 8:
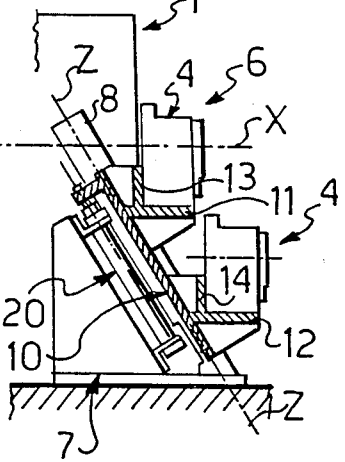

To exchange the die 3 in the extrusion working position, the hydraulic cylinder 26 of the pusher means 25 is operated to slide the die along the guides 5 and then the guides 15 and 17 and push the slide 4 toward its respective top shelf 11, placed in the preset position (see FIGS. 7 and 8).

At this stage, to exchange the die 3 on the bottom shelf 12 for the die 3 on the top shelf 11, the drive means 20 are operated to drive the carriage 10 along the guides 8 in the inclined direction Z—Z until the bottom shelf 12 locates itself in the aforesaid die exchange position, with the guides 15 and 17 aligned to the guides 5 of the press 1.

Figure 9:
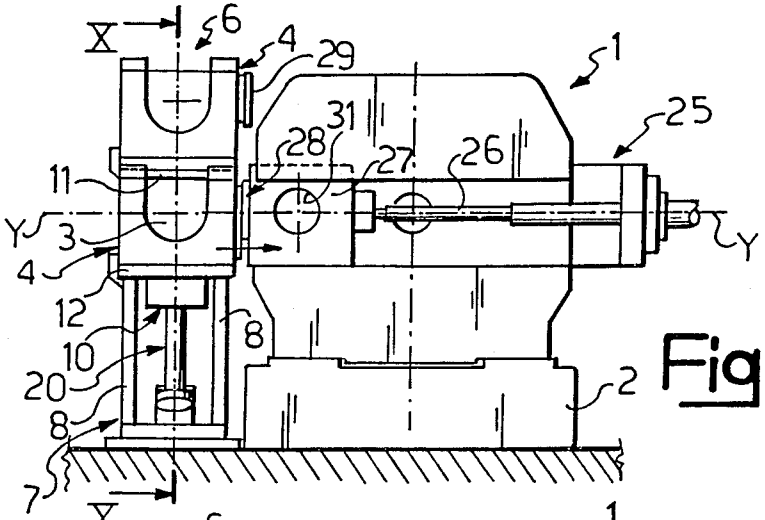
Figure 10:
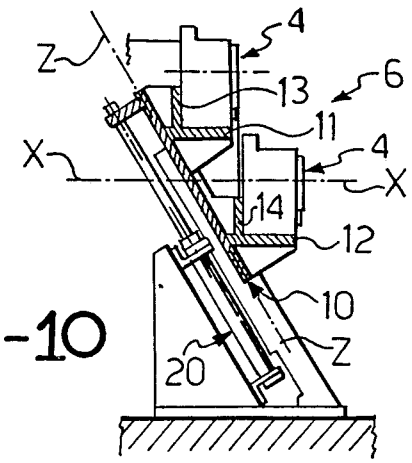

It should be noted that as a result of the carriage 10 movement along the guide 8, the hammerhead lug 29 of the slide 4 on the top shelf 11 will slide along the grooved seat 30 until it disengages therefrom; thereafter, the lug 29 of the slide 4 on the bottom shelf will enter the same grooved seat 30 to thus couple the pusher means 25 to the die holding slide 4 in the die exchange position (FIGS. 9 and 10).

Subsequently, said pusher means 25, again by the action of the hydraulic cylinder 26, will bring the slide 4 and its die 3 from the bottom shelf 12 toward the extrusion working position.

It is important to observe that the die exchange device of this invention can facilitate the manual operations of die maintenance, cleaning, and refacing. In fact, the carriage can be raised by the device drive means to bring the rest shelf of a die holding slide to be serviced to a desired level above the horizontal extrusion axis.

Advantageously, the die exchange device of this invention is compact in size, and enables the dies to be loaded or replaced on the rest shelves regardless of the positions occupied by the same.

A further advantage of the die exchange device according to the invention is that the coupling means described hereinabove have been provided between the pusher means and the die holding slides, thereby the pusher means can be coupled to and uncoupled from the slides automatically as the carriage is driven along the inclined guides.

Figures 11, 12, 13:
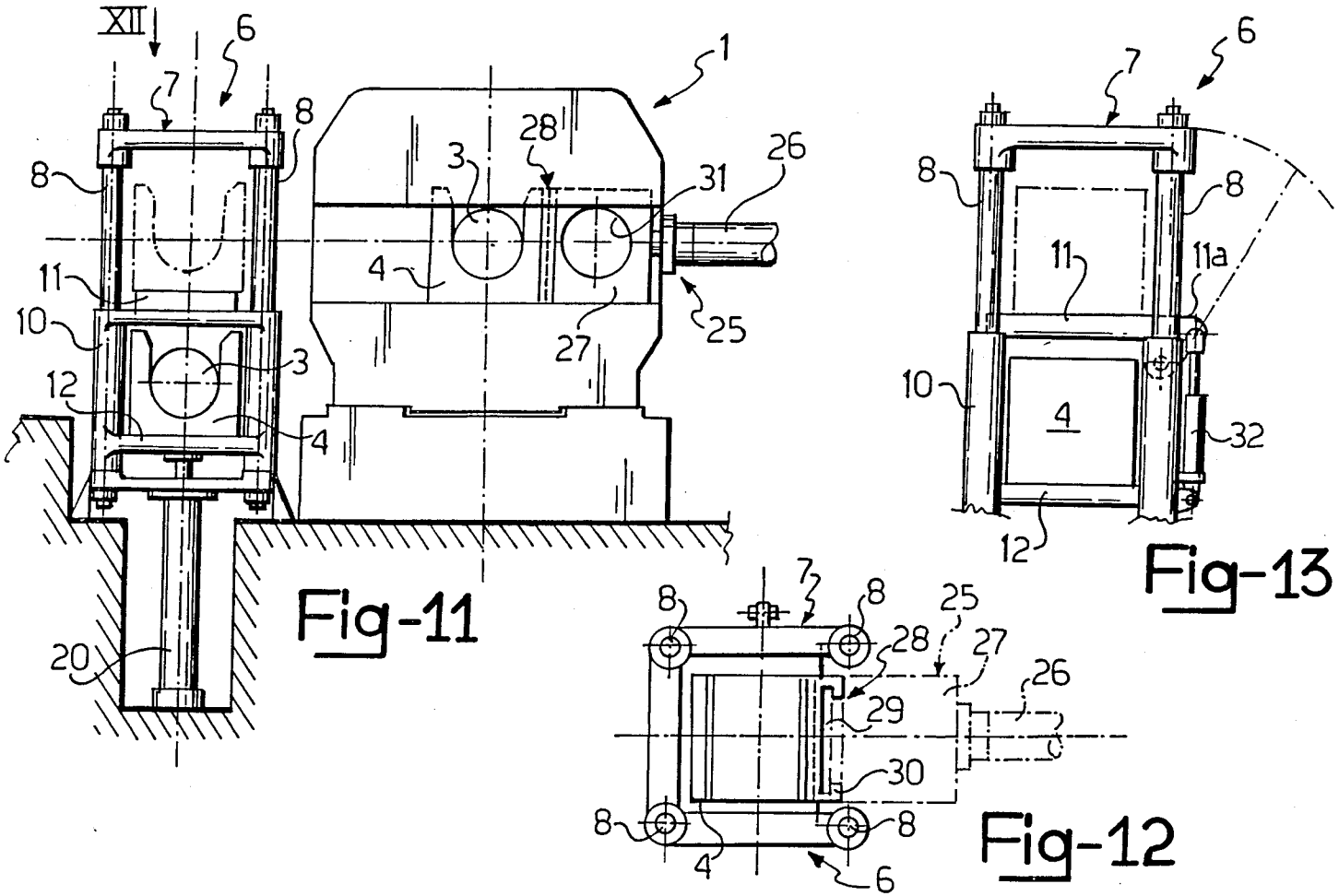
FIG. 11 is a front view showing schematically a second embodiment of a horizontal axis extruding press and a die exchange device according to this invention.
FIG. 12 is a plan view of the die exchange device shown in FIG. 11.
FIG. 13 is a side detail view of the die exchange device shown in FIG. 11.

FIGS. 11, 12 and 13 show a second example of a die holding device according to the invention, generally indicated at 6, which is located laterally of the horizontal extrusion axis press 1 close to the extrusion working position. In this second example of the device 6 according to the invention, those component parts which are constructionally or functionally the equivalent of the component parts described in connection with the die exchange device shown in FIGS. 1 to 10 will be denoted by the same reference numerals.

The die exchange device 6 comprises a supporting column 7 provided with four vertically extending guides 8 consisting of parallel cylindrical columns placed at the vertices of a quadrilateral.

The device 6 comprises a carriage 10 mounted for sliding movement along the guides 8, which carriage is formed with two superimposed rest shelves, respectively an upper one 11 and lower one 12, each adapted to carry a respective die holding slide 4.

In particular, the shelves 11 and 12 are horizontal, spaced apart by a set distance according to the slide 4 size, and are provided with identical guides of those described in connection with the first embodiment of this die exchange device 6.

Indicated at 20 is a hydraulic cylinder which constitutes drive means operative on the carriage 10, at the lower shelf 12, to drive it vertically along the guides 8 and take each shelf, 11 or 12, alternately to a set position level with the extrusion working position of the press 1.

Advantageously according to the invention, the upper shelf 11 is pivoted at one end 11*a* to one side of the carriage 10, and is, by the action of a small hydraulic cylinder 32 mounted between the end 11*a* and the carriage 10, made tiltable through an angle of at least 90°.

The die exchange device 6 further comprises pusher means 25 mounted on the press 1 to shift a die holding slide 4 from a shelf, 11 or 12, located at the above-noted set position to the extrusion working position, and vice versa.

Quite similarly to what has been described previously in connection with the first embodiment of a die exchange device according to the invention, the pusher means 25 are comprised of a hydraulic cylinder 26 operative on a movable body 27 having a hole 31 and being adapted to engage with a slide 4 via coupling means 28.

The above-noted coupling means 28 are comprised of a hammerhead-shaped lug 29 extending in a vertical direction and formed on the body 27, and of a mating grooved seat 30 open both at the bottom and at the top which is formed in each die holding slide 4.

A die 3 is exchanged by means of the second embodiment of the die exchange device 6 according to the invention in a similar manner to that previously described by operating the pusher means 25 and driving the carriage 10 by the drive means 20 in a vertical direction.

It is important to observe that the provision of a tiltable upper shelf is specially advantageous in that it makes a die contained in the slide located on the lower shelf of the carriage in the die exchange device of this invention accessible from above.

I claim:

1. A die exchange device for horizontal axis extruding presses having a working position whereat an extrusion die is held during the extrusion process, characterized in that it comprises a supporting column provided with guide extending therealong in an inclined direction from the vertical, a carriage movable along said guides and provided with at least two superimposed rest shelves in a mutually spaced-apart relationship and in a stepped arrangement and each arranged to carry a respective die holding slide, drive means operative on said carriage to take each of said shelves and respective slides to a die exchange position close to said working position, and pusher means effective to shift a die holding slide from said die exchange position to said working position, and vice versa.

2. A die exchange device according to claim 1, characterized in that it comprises coupling means operative between said pusher means and each die holding slide and consisting of a lug formed on each slide and a grooved seat with a mating shape open at opposed ends, being formed in said pusher means, said lug and said grooved seat extending along said inclined direction.

* * * * *